United States Patent [19]

Stauner

[11] 4,338,973

[45] Jul. 13, 1982

[54] CATCH MECHANISM FOR A WEAVING MACHINE

[75] Inventor: Rudolf Stauner, Constance, Fed. Rep. of Germany

[73] Assignee: Sulzer Brothers Limited, Winterthur, Switzerland

[21] Appl. No.: 152,546

[22] Filed: May 23, 1980

[30] Foreign Application Priority Data

Jun. 1, 1979 [EP] European Pat. Off. ..... 79101734.6

[51] Int. Cl.[3] ..... D03D 47/24

[52] U.S. Cl. ..... 139/439

[58] Field of Search ..... 139/437, 438, 439

[56] References Cited

U.S. PATENT DOCUMENTS 2,538,798 1/1951 Pfarrwaller ..... 139/439

2,696,222 12/1954 Pfarrwaller ..... 139/439

FOREIGN PATENT DOCUMENTS 790166 9/1935 France ..... 139/439

45-3905 2/1970 Japan ..... 139/439

*Primary Examiner*—Henry Jaudon

*Attorney, Agent, or Firm*—Kenyon & Kenyon

[57] ABSTRACT

The catch mechanism employs a straight line guideway for moving an ejector reciprocally in a straight line path. The ejector has a foot piece for engaging only the foremost gripper projectile of a series of projectiles in a channel so as to positively eject the foremost projectile. A pivotally mounted spring biased pawl is used to retain the projectiles in the channel and is biased outwardly during an ejection process by the movement of the ejector.

10 Claims, 5 Drawing Figures

CATCH MECHANISM FOR A WEAVING MACHINE

This invention relates to a catch mechanism for a weaving machine. More particularly, this invention relates to a catch mechanism for catching weft insertion gripper projectiles in a weaving machine.

Heretofore, it has been known to provide weaving machines with suitable mechanisms for inserting weft threads into a shed. In some cases, it has been known to use a gripper projectile for the insertion of a weft thread into a shed of warp threads. In such cases, the gripper projectile grips an end of a weft thread and is propelled through the shed from a picking mechanism on one side of the shed into a catch mechanism on the opposite side of the shed. After being caught, the projectile is returned to the picking mechanism via a suitable return transport means.

Generally, the catch mechanisms which have been used employ an ejector for the ejection of the projectile from the catch mechanism into the return transport means. For example, as described in U.S. Pat. No. 2,696,222, an ejector can be articulated to an oscillating drive lever for pushing through a bore in a housing of the catch mechanism in order to eject a projectile to a return transport means. In this case, the ejector is positioned so that the free end serves to push the projectile directly into the return transport means. During an ejection movement, the ejector can be pivoted more or less about the bore as a fulcrum.

However, the ejector cannot maintain a precise position before and after impingement of the free end on the projectile. Accordingly, it is not possible to obtain an exact ejection process. As a result, at the beginning of the ejection process, the free end of the ejector may strike a following projectile which is not to be ejected or may touch the following projectile in an undesired manner. This may, in turn, cause damage to the parts or an incorrect stoppage of the weaving machine.

Accordingly, it is an object of the invention to provide a catch mechanism for a weaving machine which reduces the chance of an incorrect stoppage of the weaving machine.

It is another object of the invention to provide a catch mechanism for a weaving machine which can reliably eject a sequence of gripper projectiles into a return transport means.

It is another object of the invention to avoid accidental stoppages of a weaving machine during an ejection of a gripper projectile from a catch mechanism.

It is another object of the invention to accurately control the movement of an ejector of a catch mechanism.

Briefly, the invention provides a catch mechanism for a weaving machine having a channel for receiving a sequential series of weft insertion gripper projectiles and an ejector for sequentially ejecting each projectile from the channel. In accordance with the invention, the ejector is reciprocally movable in a straight line path.

In addition, the catch mechanism has a pawl which is movable between a blocking position in the channel to retain a series of projectiles in the channel and a release position spaced from the channel to permit passage of a projectile thereby. Further, the catch mechanism employs a force accumulator for biasing the pawl into the blocking position. This accumulator is displaceable to permit movement of the pawl from the blocking position into the release position under the force of the ejector.

During movement, particularly during an ejection movement, the ejector is maintained in the straight line path, for example a vertical path, in an exact manner. Thus, the ejector can avoid striking a projectile which is not to be ejected. Thus, damage to the various parts, disturbances in the operation of the weaving machine and incorrect stoppages of the machine can be avoided.

The catch mechanism may also have a stop mounted on the pawl for movement into a depression of the ejector upon ejection of a projectile in order to limit movement of the pawl.

These and other objects and advantages of the invention will become more apparent from the following detailed description and appended claims taken in conjunction with the accompanying drawings in which:

Figure 1:
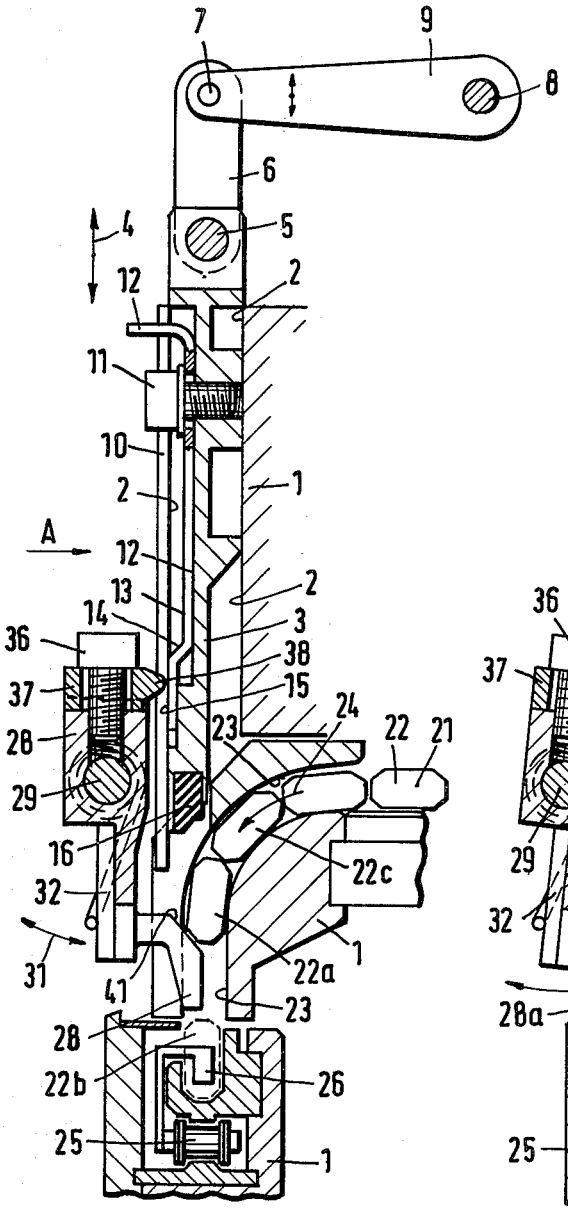
FIG. 1 illustrates a vertical sectional view through a catch mechanism constructed in accordance with the invention.

Referring to FIG. 1, the catch mechanism is employed with a weaving machine which uses a plurality of gripper projectiles to pick weft threads sequentially into successive sheds of warp threads or yarns. To this end, the weaving machine has a picking unit for picking a gripper projectile through a shed of warp yarns to a catch mechanism. As such a construction is well known, no further description is believed to be necessary.

As shown, the catch mechanism has a housing 1 in which a shaped channel 23 is formed for guiding a sequentially delivered series of gripper projectiles 22 from a catching station to an ejection station through a curved path having a horizontal section and a vertical section. In addition, the housing 1 has a vertically disposed straight-line guideway 2 in which an ejector 3 is reciprocally movable as indicated by the arrow 4 in a straight-line path. The guideway 2 intersects with the channel 23 so that the ejector 3 can move into the channel 23 in order to eject the foremost projectile **22*a* into the ejection station (see FIG. 2**).

Figure 5:
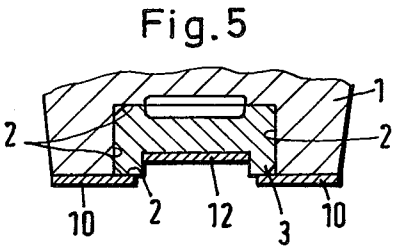
FIG. 5 illustrates a view taken on line V—V of FIG. 3.
Figure 3:
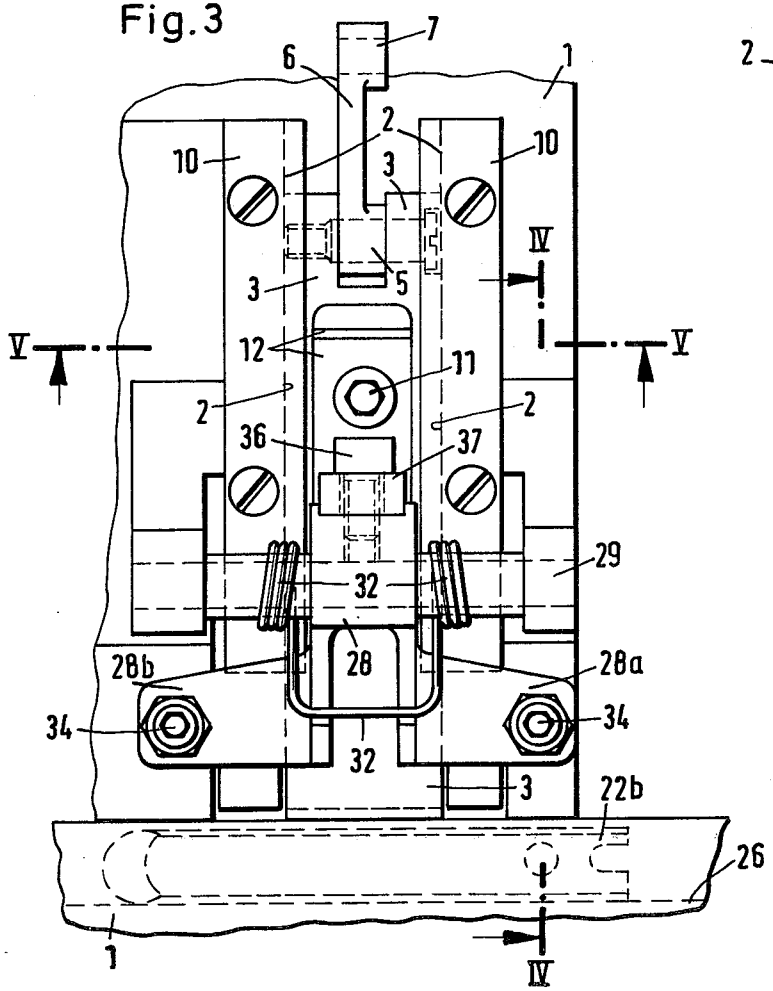
FIG. 3 illustrates a front view taken in the direction of the arrow A of FIG. 1.

As shown in FIG. 1, the upper end of the ejector 3 is articulated via a pin 5 to a link 6 which, in turn, is connected via a pin 7 to a pivotal drive lever 9 which is mounted for pivoting about a fixed pivot 8. As shown in FIGS. 1 and 3, a pair of plates 10 are mounted on the housing 1 in overlying relation to the guide way 2 (see FIG. 5) to guide the ejector 3 within the guideway 2 while retaining the ejector 3 in place.

The ejector 3 carries a plate 12 which is secured intermediately thereon via a screw 11 and which is adjustable along the vertical length of the ejector 3. The plate 12 forms a depression 13 and has a shoulder 14 at the lower end of the depression 13, as viewed, which is followed by an elevation 15. In addition, the ejector 3 carries a foot piece 16, for example of rubber, at the lower end. This foot piece 16 is shaped to engage a rear portion of the foremost projectile **22*a* in mating relation as indicated in FIG. 2**.

Figure 2:
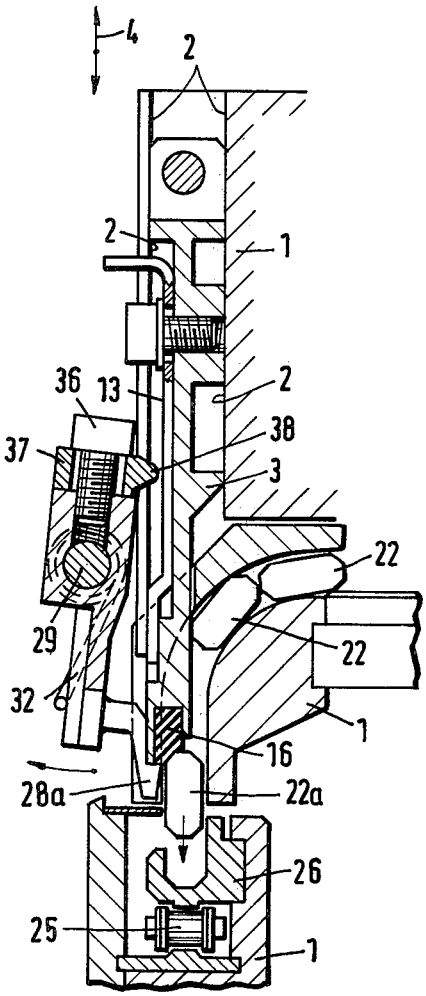
FIG. 2 illustrates a view of the catch mechanism with the ejector in an ejection position.

The catch mechanism also has a pawl 28 which is pivotally mounted about a fixed pivot 29 to pivot in the direction indicated by the arrow 31 between a blocking position, as shown in FIG. 1, and a release position, as shown in FIG. 2. In the blocking position, the pawl 28 is located in the path of the foremost projectile 22*a* in the channel 23 in order to retain the series of projectiles 22 in the channel 23. In the release position, the pawl 28 is spaced from the channel 23 in order to permit passage of the foremost projectile 22*a* under the influence of the ejector 3.

In addition, a force accumulator, for example a spring 32, biases the pawl 28 into the blocking position. This spring 32 is displaceable in order to permit movement of the pawl 28 from the blocking position into the release position under the force of the ejector 3.

Figure 4:
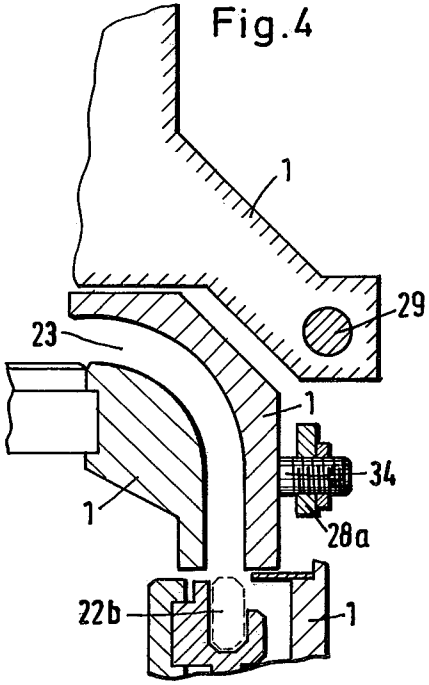
FIG. 4 illustrates a view taken on line IV—IV of FIG. 3.

As shown in FIG. 3, the pawl 28 has a pair of wings 28*a*, 28*b* which are provided with suitable apertures for passage of stop screws 34 therethrough. The stop screws 34 are threaded into the housing 1 in known manner (see FIG. 4) and serve as stops for limiting the outward motion of the pawl 28 relative to the channel 23. In addition, the pawl 28 includes a shaped piece 37 which is adjustably mounted at the upper end via a screw 36. This shaped piece 37 has a stop 38 thereon which cooperates with the elevation 15 and depression 13 of the plate 12 of the ejector 3. Further, the pawl 28 has an inclined surface 41 facing into the channel 23 to abut the foremost projectile 22*a* and, thus, retains the projectiles in place.

Referring to FIG. 1, a return transport means cosisting of a roller chain 25 and several drivers 26 passes through the housing 1 below the channel 23 at the ejection station.

During operation, after each weft insertion along a picking line 21 (as shown in FIG. 1), a gripper projectile 22 moves into the catch mechanism 1 and is checked, i.e. braked, to a stop. The projectile 22 is then moved into the channel 23 via a suitable mechanism (not shown) and is moved with the other received gripper projectiles 22 successively along a path as indicated by the arrow 24.

After each weft insertion, the ejector 3 is moved downwardly under the influence of the pivoting lever 9 which is driven in suitable timed relation to the operation of the weaving machine. The foot piece 16 of the ejector 3 thus strikes against the foremost gripper projectile 22*a*. Upon further downward movement, the ejector 3 pushes the projectile 22*a* downward against and along the inclined surface 41 of the pawl 28 causing the pawl 28 to move outwardly of the channel 23 against the bias of the spring 32 into the release position shown in FIG. 2. At the same time, the stop 38 is pivoted into the depression 13 which is now disposed opposite the stop 38. As shown in FIG. 2, the ejector 3 blocks the following projectiles 22 from moving any further along the channel 23.

Subsequently, the projectile 22*a* moves into the position 22*b* indicated in broken lines in FIG. 1, i.e. within the return transport means. The ejected projectile is then transported back into a picking unit (not shown) for a new weft insertion. During this time, the projectile 22*b* is moved in a direction normal to the plane of the drawing of FIG. 1.

After ejection of a projectile 22*a*, the ejector 3 is moved upward from the lowest position shown in FIG. 2. The pawl 28 is then pivoted under the bias of the spring 32 into the blocking position illustrated in FIG. 1 before the ejector 3 moves out of the channel 23. In this position, the pawl 28 serves to retain the following projectiles 22*c* in the channel 23. At the same time, the stop 38 moves out of the depression 13 of the plate 12. At this time, the stop 38 may move on the shoulder 14 onto the elevation 15. Thus, the plate 12 may serve as a means of positively pivoting the pawl 28 back into the blocking position illustrated in FIG. 1.

After a subsequent weft insertion, the ejection process is repeated.

Due to the vertical straight line guide way 2, the ejector 3 remains exactly in a vertical position during operation. Accordingly, an especially precise motive of operation can be obtained during the ejection process. In particular, the foot piece 16 can be prevented from prematurely striking the second from last gripper projectile 22*c* (FIG. 1) present in the channel 23 and not yet to be ejected. Thus, interference with the operation of the weaving machine can be avoided.

Alternatively, the ejector 3 and the straight line guide way 2 can be arranged obliquely within the catch mechanism housing 1, for example at an angle of from 10° to 20° to a vertical plane.

The invention thus provides a catch mechanism of relatively simple construction which is capable of avoiding inadvertent stoppages of the weaving machine during an ejection process.

The invention further provides a catch mechanism wherein an ejector is prevented from striking gripper projectiles which are not to be ejected or from brushing or shattering such projectiles.

What is claimed is:

1. A catch mechanism for a weaving machine, said catch mechanism having a channel for receiving a sequential series of weft insertion gripper projectiles, said channel having a horizontal section and a vertical section; and an ejector for sequentially ejecting each projectile from said channel, said ejector being reciprocally movable in a straight line path into and out of said vertical section.

2. A catch mechanism as set forth in claim 1 which further has a pawl movable between a blocking position in said channel to retain a series of projectiles in said channel and a release position spaced from said channel to permit passage of a projectile thereby, and a force accumulator biasing said pawl into said blocking position, said accumulator being displaceable to permit movement of said pawl from said blocking position into said release position under the force of said ejector.

3. A catch mechanism as set forth in claim 2 wherein said ejector has a depression therein and said pawl has a stop movable into said depression upon ejection of a projectile.

4. A catch mechanism for a weaving machine, said catch mechanism having a channel for receiving a sequential series of weft insertion gripper projectiles;

an ejector for sequentially ejecting each projectile from said channel, said ejector being reciprocally movable in a straight line path and having a slide thereon with a depression therein;

a pawl movable between a blocking position in said channel to retain a series of projectiles in said channel and a release position spaced from said channel to permit passage of a projectile, said pawl having a stop movable into said depression upon ejection of a projectile; and a force accumulator biasing said pawl into said blocking position, said accumulator being displaceable to permit movement of said pawl from said blocking position into said release position under the force of said ejector.

5. A catch mechanism for a weaving machine, said catch mechanism having a channel for receiving a sequential series of weft insertion gripper projectiles;

an ejector for sequentially ejecting each projectile from said channel, said ejector being reciprocally moving in a straight line path and having a depression therein;

a pawl movable between a blocking position in said channel to retain a series of projectiles in said channel and a release position spaced from said channel to permit passage of a projectile thereby, said pawl including an adjustably mounted shaped piece therein having a stop mounted thereon for movement into said depression upon ejection of a projectile; and a force accumulator biasing said pawl into said blocking position, said accumulator being displaceable to permit movement of said pawl from said blocking position into said release position under the force of said ejector.

6. A catch mechanism for a weaving machine comprising a housing having a shaped channel therein for guiding a sequentially delivered series of gripper projectiles therein from a catching station to an ejection station through a curved path having a horizontal section and a vertical section; and an ejector reciprocally mounted in said housing for movement in a straight-line path to move into said vertical section of said channel to eject a projectile in said ejection station from said channel.

7. A catch mechanism as set forth in claim 6 which further comprises a pawl movable between a blocking position in said channel to retain a series of projectiles in said channel and a release position spaced from said channel to permit passage of a foremost projectile thereby, and a force accumulator biasing said pawl into said blocking position, said accumulator being displaceable to permit movement of said pawl from said blocking position into said release position under the force of said ejector.

8. A catch mechanism as set forth in claim 7 wherein said force accumulator is a spring.

9. A catch mechanism as set forth in claim 6 wherein said straight line path is disposed at an angle of from 10° to 20° to a vertical plane.

10. A catch mechanism for a weaving machine comprising a housing having a shaped channel therein for guiding a sequentially delivered series of gripper projectiles therein from a catching station to an ejection station;

an ejector reciprocally mounted in said housing for movement in a straight-line path to move into said channel to eject a projectile in said ejection station from said channel, said ejector including a foot piece for engaging a foremost projectile in said channel at said ejection station and an intermediately disposed plate having a depression therein;

a pawl movable between a blocking position in said channel to retain a series of projectiles in said channel and a release position spaced from said channel to permit passage of a foremost projectile thereby, said pawl having a stop movable into said depression upon ejection of a projectile; and a force accumulator biasing said pawl into said blocking position, said accumulator being displaceable to permit movement of said pawl from said blocking position into said release position under the force of said ejector.

* * * * *